United States Patent [19]

Borcher et al.

[11] 4,106,410

[45] Aug. 15, 1978

[54] LAYERED FRAGMENTATION DEVICE

[75] Inventors: Charles A. Borcher, Maitland; William R. Porter, Orlando, both of Fla.

[73] Assignee: Martin Marietta Corporation, Orlando, Fla.

[21] Appl. No.: 249,458

[22] Filed: Apr. 28, 1972

Related U.S. Application Data

[63] Continuation-in-part of Ser. No. 769,464, Aug. 26, 1968, abandoned, which is a continuation-in-part of Ser. No. 518,481, Jan. 3, 1966, abandoned.

[51] Int. Cl.[2] ..... F42B 13/48

[52] U.S. Cl. ..... 102/67; 102/66; 102/90

[58] Field of Search ..... 102/64, 65, 67, 66, 102/68, 58, 90, 2

[56] References Cited

U.S. PATENT DOCUMENTS

| | | | |
|---|---|---|---|
| 1,236,736 | 8/1917 | Miller | 102/58 |
| 2,304,060 | 12/1942 | Baylor | 102/68 |
| 3,298,308 | 1/1967 | Throner | 102/67 |

FOREIGN PATENT DOCUMENTS

| | | | |
|---|---|---|---|
| 1,202,477 | 1/1960 | France | 102/62 |
| 20,902 of | 1912 | United Kingdom | 102/2 |
| 127,906 | 6/1919 | United Kingdom | 102/67 |

*Primary Examiner*—Harold Tudor
*Attorney, Agent, or Firm*—Julian C. Renfro; Gay Chin; James B. Eisel

[57] ABSTRACT

In order to achieve a fragmentation device having a highly effective coupling between the fragments and the high explosive used therewith, we provide in accordance with this invention a novel layered warhead in which uniformly thick layers of fragments are interspersed with well defined layers of detonating, military type explosive, thus defining a desirably low charge-to-metal ratio, and making possible a predictable, uniform pattern as well as very high fragment velocities.

7 Claims, 6 Drawing Figures

LAYERED FRAGMENTATION DEVICE

This application is a continuation-in-part of our application Ser. No. 769,464, filed Aug. 26, 1968, now abandoned which in turn was a continuation-in-part of our application Ser. No. 518,481, filed Jan. 3, 1966 now abandoned.

This invention may be regarded as having a definite relationship to the allowed patent application of Borcher, Porter and Harris entitled "Incendiary Fragmentation Warhead", Ser. No. 609,777, filed Sept. 2, 1975.

This invention relates to a layered fragmentation device, and more particularly to a device comprising fragments disposed in discrete alternating layers with explosive material and adapted for use as a warhead with missiles, rockets or shells, as well as being usable in connection with mines, bomblets or other fragmentation devices. In each instance our layered fragmentation device offers novel geometry possessing more effective energy coupling between explosive and fragments than was previously possible, as well as offering the capability of providing uniform radial or axial fragmentation patterns or even some combination of these, so as to assure a more lethal pattern than was previously possible.

In the past, a number of fragment type warheads have been proposed, but these have suffered from numerous disadvantages, including the fact that a comparatively high explosive-charge-to-metal parts ratio was required in order to achieve the desired fragment projection velocity. Many if not most prior art configurations typically involved a single explosive burster charge surrounded by fragments, but because of low coupling efficiencies, a considerable amount of explosive was required if desirably high fragment velocities were to be achieved with a limited number of fragments.

The prior art has also involved warheads using successively detonated charges, but with well defined time intervals, usually of several seconds, existing between the explosions of the various charges. However, such devices are not herein involved.

In accordance with the present invention, a novel layered fragmentation device is taught which involves two or more well defined layers of fragments, typically of uniform thickness, with each fragment layer being separated by suitable layer of detonating, military type explosive material. As will be seen, our novel layered fragment device may take the form of a succession of cylindrical layers; a stacked longitudinal array of substantially planar layers; or even a wrapped or spiral embodiment. It is understood that in each instance, by the use of our novel layering concept, the fragments of the various discrete layers alternated with explosive may be detonated substantially simultaneously so as to cause fragments to be projected in a highly uniform and highly desirable pattern upon detonation of the explosive.

The terminology "substantially simultaneously" as used above is employed in order to clearly distinguish the characteristics of our weapon from devices of the type such as taught in the Baylor U.S. Pat. No. 2,304,060, wherein two charges are used, and two distinct bursts on the same trajectory are obtained. Black powder may be disposed in the base of such a device, and is used to project shrapnel from within an outer steel case, whereas the other explosive, such as of nitrocellulose, is used for bursting the case several seconds later, after the shrapnel has been projected.

Actually, the various layers of explosives of our present invention are detonated successively, but with a given layer detonating within microseconds of the other layers, as part of a pre-established sequence which we have been able to identify only by the use of very sophisticated instrumentation, including for example the use of ionization probes deployed within the explosive.

For example, as the detonation front created by a suitable detonation means located in the innermost explosive charge reaches the first fragment layer, such layer is subjected to great compression, which compression is then transmitted to the adjacent layer of explosive, which may of course be a surrounding layer. Before such adjacent layer detonates, it is compressed to a higher energy density, which means more energy is caused to exist in such subsequent explosive layer because of the compressed state resulting from detonation pressure created against or adjacent the first fragment layer.

Similarly, the compression process applies to each successive layer of fragments and explosive, until the final or outer layer of fragments is reached. This outer layer of fragments, having by definition no external explosive layer, has a greatly enhanced pressure differential owing to detonation within of the higher energy density explosive layer and is thus burst or ejected at a higher velocity than would otherwise be the case in a nonlayered device.

Consequently, it can be shown that intermediate fragment layers are momentarily surrounded by detonation pressures, resulting from the internal and external explosive layers, and velocity is not as readily propagated to these intermediate or inner fragments because of low differential pressure that exists across the fragment layers. Then, when the outer fragment layer is ejected, the differential about the next inner fragment layer increases and this layer is ejected usually at slightly lesser velocity. This process is repeated as the fragment ejection proceeds to the innermost layer.

When two or more layers of fragments and explosive are detonated by a center burster, the explosive energy is dissipated in the form of very high pressures against the surrounding layers of fragments and explosives. The explosive detonation front is propagated through the layers of fragments and explosive at essentially right angles to the planes of intersection between such layers. Therefore, for a few microseconds after the center burster is detonated, energy is absorbed by the adjacent or outer layers of explosive, which are instantly compressed to a higher density. When the outer explosive layers receive sufficient energy to detonate, they do so with release of more energy per pound because of the energy added in creating the higher density. Thus, it has been shown in connection with this invention that the outer, highly compressed layer of explosive, having only ambient pressure externally, will couple considerably increased energy to the outer layer of fragments, giving them a much higher velocity than would have been obtained without the use of our novel layered explosive-fragment configuration. Further, much more desirable and predictable fragment patterns can be obtained by explosive devices in accordance with our invention, than were possible by following teachings of the prior art.

Thus, a key feature that distinguishes our invention from the prior art is the use of a multiplicity of alternating layers of fragments and explosives. In each embodiment of this invention, we have an arrangement in which a detonator is used that is closer to one layer of fragments and explosive than to the others, with the detonation front proceeding successively across each of the layers. What may be regarded as a first layer of explosive is in fact detonated before the other layers, and in so doing causing a compression of such other layers of explosives as the fragment layer tends to expand. As pointed out hereinabove, when this compression takes place, it actually adds energy to such explosive layers, thus enabling the final layer of explosive, that is, the layer closest to the exterior and coupled externally to atmospheric pressure, to detonate with greater force than would otherwise have been possible, thus greatly increasing fragment velocities, enhancing fragmentation patterning, and therefore magnifying the lethality of our weapon.

However, it should be noted that the successive detonations take place with regard to time in the microseconds region, which is to say that the detonation of the various layers of our device takes place substantially simultaneously in that only a very few microseconds elapse between the time of the detonation of the first explosive layer and the detonation of the final explosive layer. This of course is a modus operandi quite distinct from that of prior art devices wherein fragment layers are not used to build up the explosive layer energy density, and wherein the detonation proceeds at normal energy density. Significantly, our invention results in an improved fragment pattern dispersed, comprising successive yet partially overlapping layers of fragments.

Our invention is capable of a wide variety of utilizations and embodiments. For example, in the event a warhead constructed in accordance with this invention is to be used against ground targets such as vehicles and personnel, a large number of fragments deployed in a wide beam spray angle could be utilized. In order to achieve such wide beam spray angle, we may use either no end plates or else end plates having layered fragmentation construction. In contrast, we may utilize a warhead having a narrow beam spray angle in the event that a target's location is accurately determined, or for a target such as an incoming missile, the location of which is accurately determined. In these latter instances, we utilize end plates on each end of the spiral or cylindrical configuration, for whether these end plates are solid metal discs or explosive discs, such end plates nevertheless serve to keep the laterally exploding fragmentation pattern at a relatively small angle pattern. In addition, by employing the axial fragment projector utilizing a layered, but not cylindrically layered arrangement, a high density fragment pattern can be very accurately placed, which may be desirable in the event the target position is well known.

As will be apparent to those skilled in the art, our novel fragmentation devices are not limited to the use of any particular form of fragment, for manifestly the fragmentation layers may be of rectangular solids, spheres, or any other regular or irregular configuration. The rectangular solids may be created either by the use of discrete fragments secured in place such as by the use of a form of adhesive tape, or as an entirely different approach, scored cylinders of metal may be used, such that when detonation of the explosive takes place, a multitude of rectangular solids is at once created as a result of the break-up of the scored cylinder. Other fragmentation arrangements will also be apparent to those skilled in the art, such as the use of notched wires, rods, and the like, but in each instance the layers are essentially solid structures of substantially uniform thickness.

In each of these arrangements, the outermost layer of fragments is preferably enveloped by a suitable casing that protects the device during handling and prevents the premature dispersal of the fragments. If our novel fragmentation device is to be used in artillery shells for example, this casing would be metal, such as of scored cylinder construction, whereas if our fragmentation device is to be used in a rocket, it may be entirely suitable for the outer casing to be of fiberglass that is directly disposed over the outermost layer of discrete fragments. In embodiments of our invention in which the fragments are discrete at the time of manufacture, we preferably impregnate the entire device with a resin such as epoxy resin so as to bond the fragments together in a desirable manner. It should therefore be seen that we do not utilize or teach an arrangement in which balls or fragments are scattered through or separately embedded directly in the explosive.

Depending on the intended utilization of our layered fragmentation device, a variety of detonation arrangements may be utilized. For example, our novel device can utilize a center burster with it being understood that when detonation of the center burster and layered explosive takes place, a much higher coupling efficiency is obtained, which results in the fragments being projected in a controllable high-velocity pattern that is quite capable of causing considerable damage to an enemy target. Quite significantly, these results are obtained utilizing a desirably low charge-to-metal ratio, which of course means that for a given number of pounds of explosive, more kill power is provided.

A center burster may be used to provide increased average velocity of the fragments and to increase the velocity of the outermost layers. This technique would particularly be used in the event a cylindrical, non-wrapped configuration is employed. The detonator may either be disposed in the center burster or utilized in explosive end plates, as conditions may warrant.

For the embodiment of this invention which teaches the spiral wrap configuration, center initiation is preferably utilized, which causes the detonation front to proceed at essentially right angles through the various layers of explosive, while following the principles and attaining the results described in connection with previous embodiments of this invention. Alternatively, we can use a line wave generator disposed at the location of the outermost end of the wrapped explosive.

It is therefore a principal object of our invention to provide a layered fragmentation device enabling very high fragment velocities to be achieved, and producing uniform, effective fragmentation patterns.

It is another object of our invention to provide a fragmentation device having a highly effective coupling between the fragments and the high explosive used therewith, and defining a desirably low charge-to-metal ratio.

It is yet another object of our invention to provide a warhead in which a number of alternating layers of fragments and explosive are utilized, with the arrangement being such that a detonation front is created that passes through the various layers of fragments and explosive at essentially right angles to the intersections between such layers, thus compressing the explosive layers to higher energy densities before they detonate, and thereby considerably increasing the force with which fragments are dispersed.

It is still another object of our invention to provide a warhead made up of alternating layers of fragments and explosive, which explosive layers detonate substantially simultaneously, but yet with sufficient time elapse between the detonations of the various layers that a very desirable patterning of fragments results.

These and other objects, features and advantages will be more apparent from the appended drawings in which.

Figure 1:
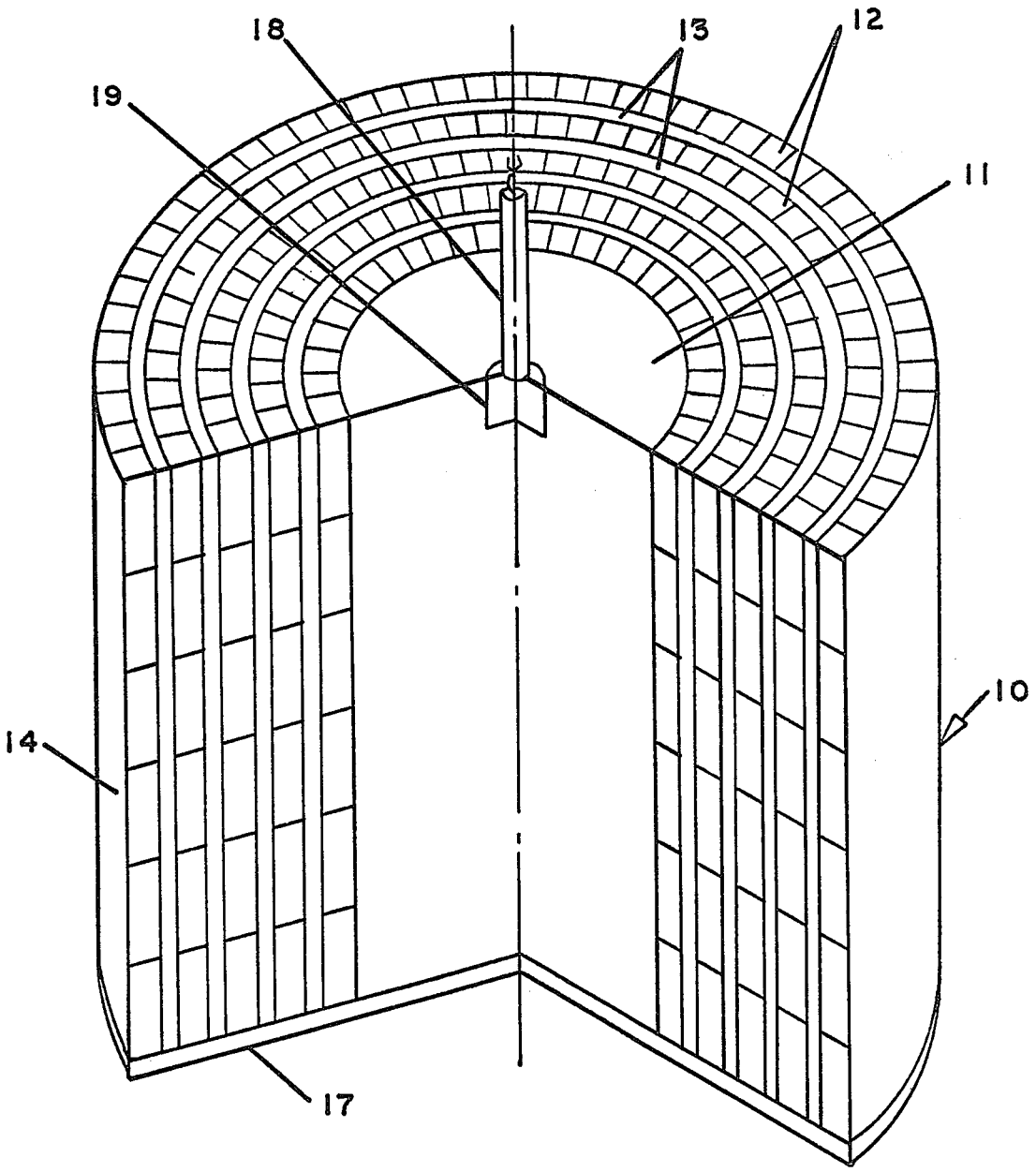
FIG. 1 is an illustrative sectional view of a novel concentric layering embodiment, such as for a warhead.

Turning now to FIG. 1, it is revealed that layered device 10 in accordance with this invention has a center burster 11, around which are arrayed numerous fragments, such as rods 12 that are deployed in alternate discrete cylindrical layers with explosive layers 13. Other forms of fragments may of course be used, although we prefer that each fragment layer be an essentially solid structure of essentially uniform thickness. As will be evident from this figure, the rods 12 in this embodiment are each in the configuration of a discrete rectangular solid, with the rods in each layer being arranged in several parallel rows to form a generally cylindrically-shaped configuration. In the present illustration, several rows of rods are employed, but it is of course to be understood that a larger or smaller number may be employed if desired. The rods 12 can be of low carbon steel and possess a length to thickness ratio of 1 to 1 to >30 to 1.

Between each layer of rods a discrete layer of explosive 13 is disposed, which explosive is a detonating, military type explosive such as Composition B, Octol or the like. Detonation of the center burster is brought about by a conventional electric initiator 18, which in turn causes the booster 19 to function and detonate the explosive. The explosive detonation is propagated through the layers of fragments and explosive at essentially right angles to the planes of intersection of the various layers, which in this instance is radially outwardly. The detonation of the layer nearest the detonation means serves to expand the adjacent fragment layer against the adjacent or surrounding explosive layer, thus compressing such explosive layer to a higher energy density before it detonates. This explosive layer detonates a very small increment of time after the detonating means detonates, and it in turn causes a compression of the next explosive layer, and so on, with the result being that the energy in each successive layer is increased, thus causing, when detonation reaches the outer portions of the device, the outermost fragments to be ejected at a particularly great velocity, with each successive fragment layer thereafter ejected, but with a very uniform and favorable fragment pattern for the warhead thus being created.

Thus, the several explosive layers are detonated substantially simultaneously, although as we established through the use of sensitive instrumentation, involving the use of ionization probes implanted in the layers of the device, there typically is an elapse of several microseconds (five or less) between the detonation of the first and last explosive layers. As previously indicated, the rods are caused by the controlled detonation of the various explosive layers to be dispersed outwardly at great velocity and in a very desirable, highly controlled pattern. The outermost fragment layer is typically surrounded by a casing 14, although if the outermost layer of fragments is to be created from a scored cylinder, the scored cylinder itself serves as the casing.

Alternatively to or in conjunction with the foregoing, an explosive disk 17 may be used on one or both ends of the cylinder formed by the various layers constituting the device of FIG. 1.

Quite significantly, by the use of alternate layers of rods and explosive all in direct contact, very effective coupling of explosive to fragments is brought about, with resultant high velocities and effective patterning that will enable an enemy target to be dealt a crippling blow if detonation of our warhead takes place within a reasonable range thereof. Spherical fragments, which, because of their relatively small contact area with the explosive, may be desirable for creating a large velocity gradient, whereas fragments in the nature of rods or cubes are to be used when velocity gradients are to be minimized and fragment velocities are to be maximized.

As an example of one configuration in accordance with our invention a warhead in accordance with FIG. 1 was constructed to have a total active weight of 20.6 lbs., of which 4.1 pounds were explosive, 16.0 pounds were fragments, and 0.5 pound inert. This of course is a charge-to-metal ratio of 0.25. With this arrangement, the maximum fragment velocity was found to be 4,242 feet per second, and the mean fragment velocity 4,000 feet per second. These results exceeded the range of velocities obtained using a conventional warhead of the same charge-to-mass ratio, in which 3.1 pounds of explosive, 14.1 pounds of fragments and 0.5 pound inert were used, for in latter instance, the maximum fragment velocity was 4,327 feet per second, and the mean fragment velocity 3,400 feet per second.

From the standpoint of energy, however, the clear superiority of our warhead was evident, inasmuch as the total energy of the fragments in footpounds was $4.04 \times 10^6$ whereas for the conventional warhead the total energy of the fragments was $2.57 \times 10^6$ foot-pounds. Very significantly, the fragment energy per pound of explosive was $0.99 \times 10^6$ foot-pounds for our warhead as compared with a $0.83 \times 10^6$ foot-pounds for the conventional warhead. This of course means that our explosive-fragment layered warhead has an efficiency of 55% compared to 47% for the equivalent conventional fragmenting warhead design in utilizing explosive energy.

From this performance comparison as well as detailed kill effectiveness analysis we were able to conclude that our layered concept provides a significant increase in effectiveness by more efficient coupling of available explosive energy to discrete fragments and subsequent control of high velocity fragment distribution patterns.

Figure 2:
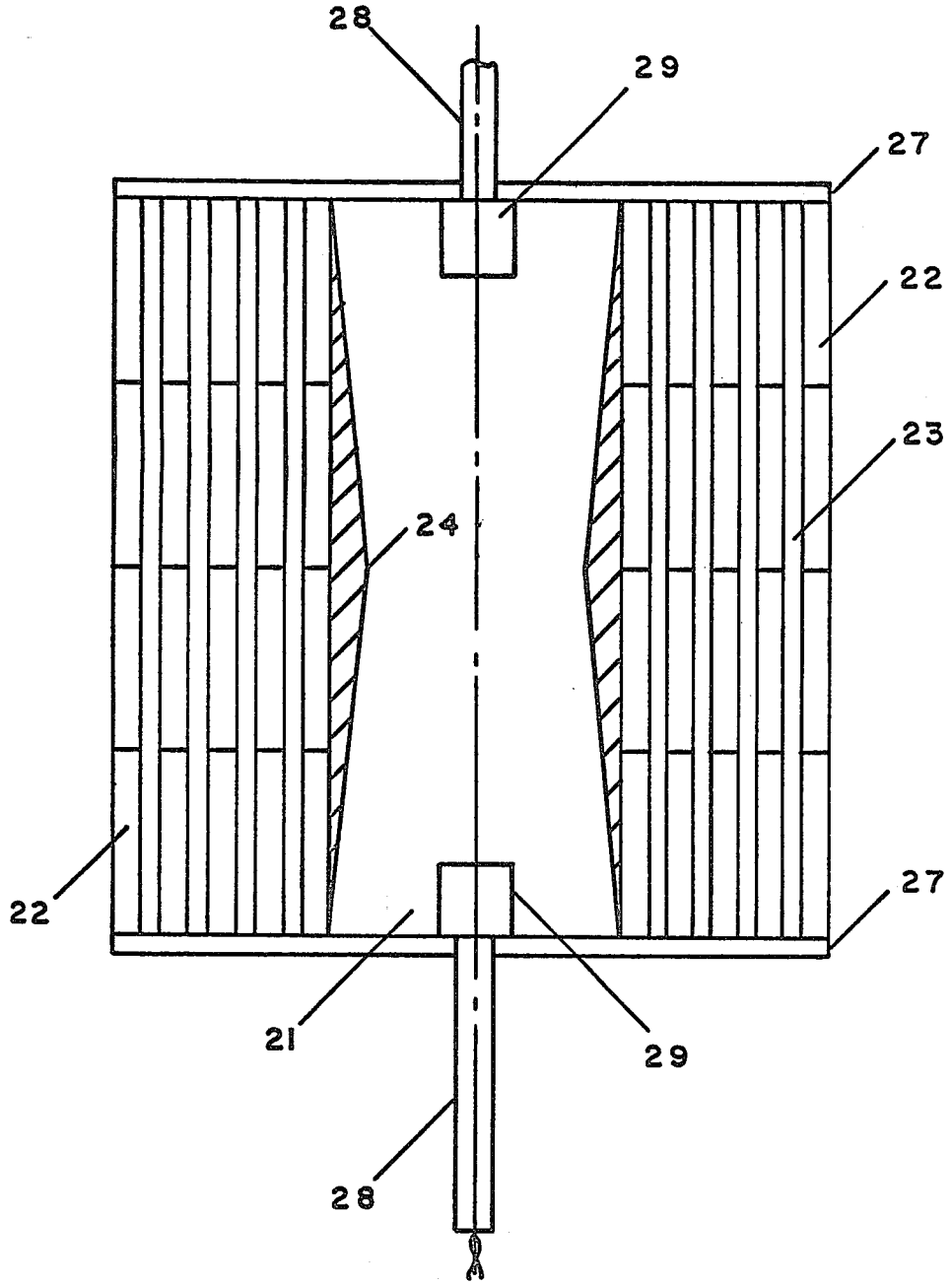
FIG. 2 is an illustrative sectional view, showing the use of a shaped center burster in a layered fragmentation device in accordance with our invention.

Turning to FIG. 2, it will be noted that disposed between center burster 21 and the first layer of rods 22 is a contoured inert filler 24. This possesses the configuration of a cylinder whose interior ends are flared outwardly somewhat, with the result that more of the explosive material of the center burster 21 is disposed at the ends of the warhead than in the middle. As a direct result of this fact, we have established through tests that the fragment pattern is more nearly radial, or in other words, the beam spray angle of the rods is reduced. This type of configuration is typically employed when a high density pattern is required. However, as will be understood, the configured filler may be used in an entirely different configuration than that shown if a different pattern is desired. End plates 27 may be used if a narrow beam spray angle is desired, and these may be of metal or explosive material as desired. The initiator 28 and booster 29 function in the usual manner to detonate the explosive 21, which in turn causes explosive layers 23 to detonate.

It should be noted that the explosive used may be castable, such as Octol or Composition B, or it may be a plastic explosive, such as duPont Detasheet or Composition C-4.

Figure 3:
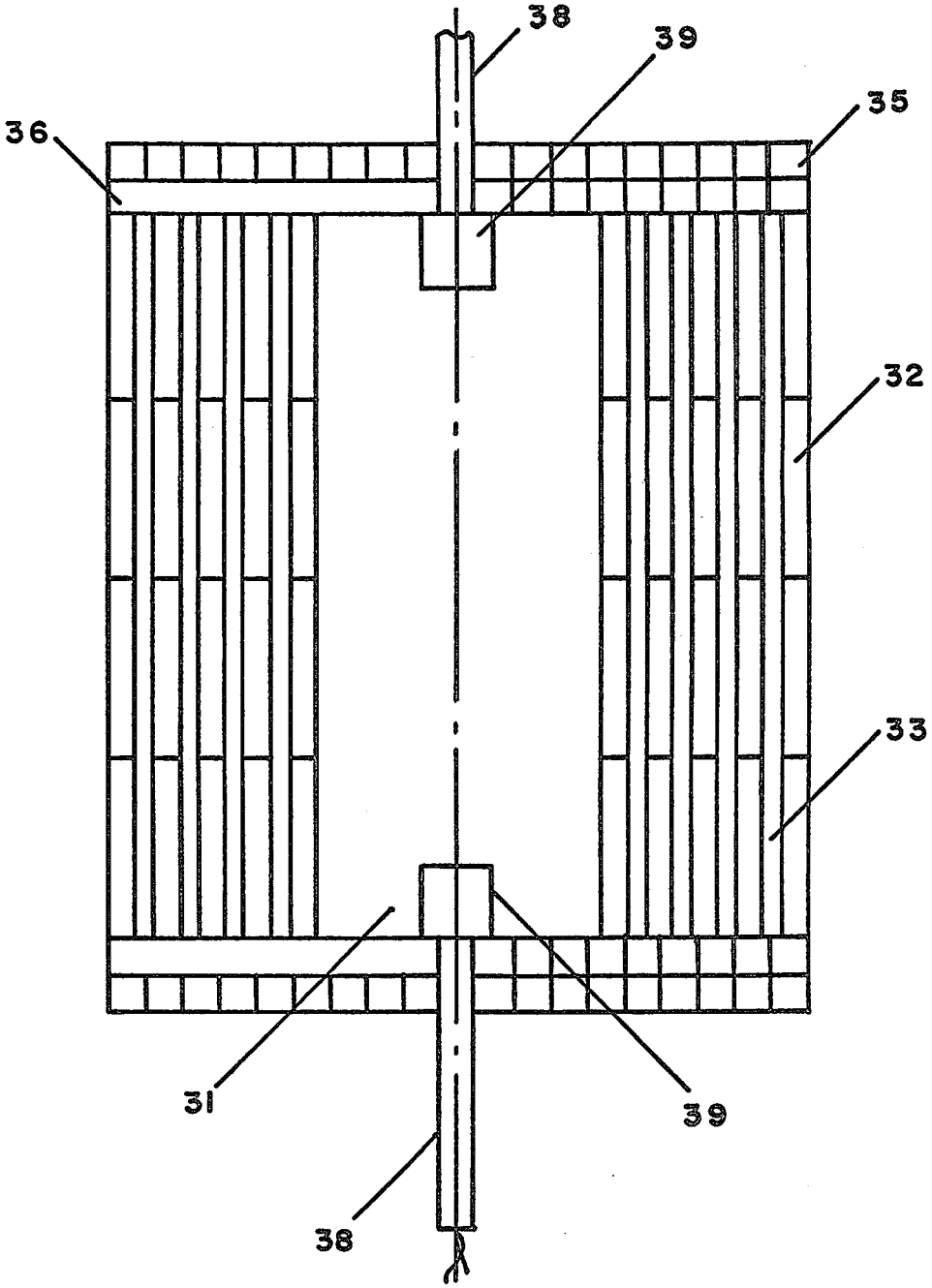
FIG. 3 is a cross-sectional view revealing concentric layering in conjunction with two variations of fragmenting end plates.

Turning to FIG. 3, it will be noted that in this version in addition to the rods 32, a number of metal fragments 35 are provided at the ends of the warhead, these serving to aid in confining the beam spray of the radial fragments, as well as yielding effective axial fragment projection. As will be noted, one portion of this figure reveals the use of an explosive layer 36 between the end rods 35 and the main portion of the warhead, whereas in accordance with an embodiment as depicted on the right hand side of this figure, no additional explosive layer is employed, other than the center burster 31. The initiator 38 and booster 39 function to detonate the explosive material 31 and 33.

With regard to FIGS. 1 through 3, it should be noted that scored solid cylinders or cylindrical wrappings of notched wire may be substituted for the discrete rods disposed in the cylindrical relationship. As previously mentioned, for high G uses, a metal outer casing is used, which itself may be scored to form fragments, whereas for rocket, mine or other usage, the casing could be of fiberglass instead of metal if such be desired.

Figure 4:
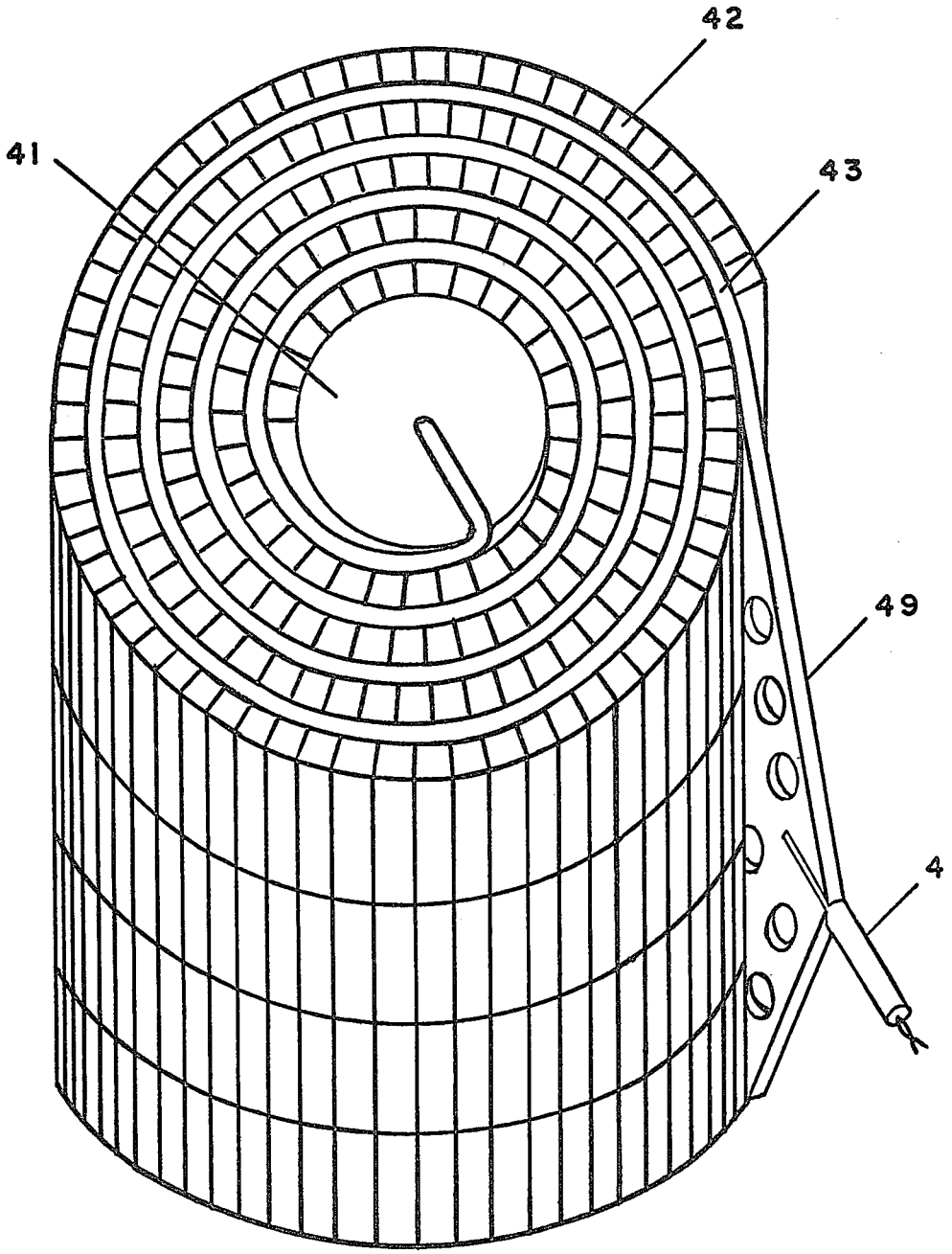
FIG. 4 is an embodiment of our invention in which spiral layering is taught.

Turning to FIG. 4, an embodiment of our layered warhead invention is set forth wherein a spiral layering technique is employed, involving a construction wherein a layer of rods 42 and explosive 43 is rolled several times about a center burster 41 so as to achieve substantially the same construction as depicted in FIG. 1. Although the fragment pattern resulting from the use of a warhead constructed in this manner is not quite as precisely symmetrical as results from the concentric configuration of FIG. 1, nevertheless in accordance with this embodiment we have found that the production and labor costs may be less than in the other embodiment.

As to variations of our basic invention, it should be noted that increasing the center burster charge raises the average velocity while increasing the thickness of the explosive layers 43 increases the incremental velocity of each layer, and vice versa. If a large velocity distribution is desired a small center burster is used to keep the inner layer velocity low. The weight of the layers of explosive is adjusted to the incremental velocity desired in the layers. If a dense fragment pack is desired when fired, the weight of explosive in each layer is minimized.

Another feature of this invention is that the size of the fragment may be different in each layer. This permits a more uniform energy distribution, for the fast outer layer of fragments could be small and the inner layer more massive to more equally distribute the energy per fragment. In addition, fragments of varying sizes may be intermixed in any or all layers to provide optimum kill energies against a wide variety of targets. For anti-personnel use, 10 grain fragments may be used, whereas against trucks, 30 grain fragments are more desirable.

As to the form of detonation used in the embodiment in accordance with FIG. 4, we prefer to use center initiation, which causes the detonation front to proceed at essentially right angles through the various layers of explosive, while following the principles and attaining the results described in connection with previous embodiments of this invention. Alternatively, we can use a line wave generator 49 disposed at the location of the outermost end of the wrapped explosive, which when initiated by device 48, serves to cause the detonation front to arrive at the fragmentation layers as a plane front. This plane front is achieved in accordance with conventional techniques by providing in the line wave generator a tortuous path for the explosive propagation.

Detonation of the spirally disposed explosive in latter instance occurs from the outside layers toward the center, thus causing a progressive unwrapping motion and the projection of fragments as a continuously unwrapping sheet. We have found that the velocity of the fragments will be noticeably affected by the thickness of the explosive layers used. If desired, we can use a protective layer between the explosive and the fragments, this protective layer, for example, being of gun tape or the like.

We have also found it desirable to utilize inert material to bind the various components together, which material is injected during manufacture of a layered explosive device by utilizing vacuum techniques. This causes the deep permeation of the binder material, which may be of a resin such as epoxy resin, with the result being that the fragments are solidly bound together. This of course prevents undesirable relative motion by the fragments and it also assures additional structural strength for a warhead.

Our layered fragmentation device lends itself to a wide range of uses, and as previously mentioned, end plates may be employed in conjunction with the cylindrically shaped central portion of a warhead if it is desired to obtain a narrow beam spray. These end plates may be either of massive metal construction, may be explosive discs, or explosive discs with fragments, as may be preferred.

As will be apparent, the central explosive layered portion need not be precisely cylindrical, as depicted in the first several figures, for if desired such main portion of the device could be hour glass shaped, or even bulge outwardly in the center portion or have an ogival forward shape, as may be desirable from the standpoint of controlling beam spray in a desirable manner.

Figure 5:
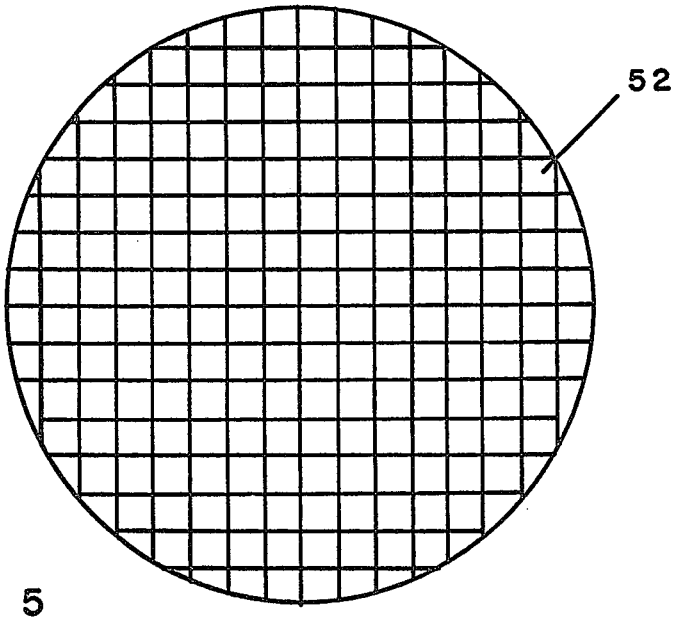
FIG. 5 is a top view of a fragment pattern that may be used in conjunction with axial layering.
Figure 6:
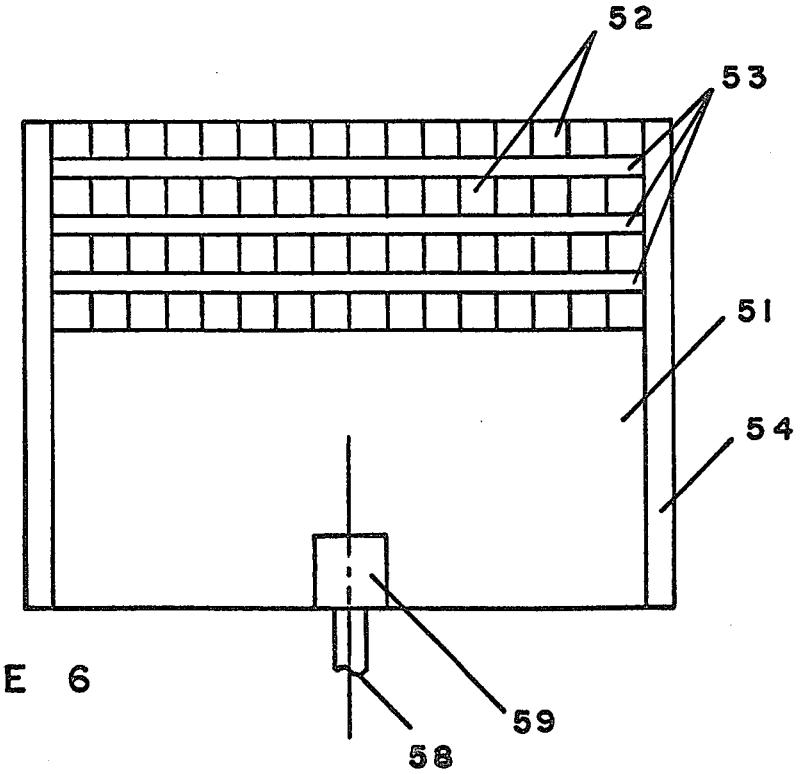
FIG. 6 is a side elevational view related to FIG. 5, in which further details of axial layering in a warhead in accordance with this invention is revealed.

FIGS. 5 and 6 represent an axial projector warhead that has, for example, four fragment layers separated by three explosive layers, placed on the end of a cylindrical explosive charge 51. Explosive layers 53 are typically detonated by shock through the fragments 52, with the explosive detonation being propagated at essentially right angles to the intersections between the various layers of fragments and explosive. The detonation of the explosive layers takes place substantially simultaneously, as previously discussed. Alternatively, the explosive layers may be detonated by a sleeve if explosive around the fragments which initiates the explosive layers at their edges.

The assembly shown in these figures may be encased in a metal cylinder 54 for protection of the explosive. In this case the metal cylinder serves to confine fragment dispersion. The fragments may be rods, cubes, spheres, plates or hexagonally shaped depending on the target requirements. Fragment velocity can of course be increased and dispersion decreased by increasing the length to diameter ratio of the main charge. Initiation can either be single point, such as by the use of a J-2 initiator 58 and a booster 59, or peripherally by the inclusion of a thin disc of sheet explosive, such as Detasheet. In the latter instance, an initiator such as an E-94 may be used in a control portion of the disc. In the latter technique it is desirable to include a buffering material such as polyurethane between the sheet explosive disc and the main explosive charge.

It should be borne in mind with regard to the embodiments of FIGS. 1 and 4 that the use of a center burster may be dispensed with if desired, but we prefer to use the center burster inasmuch as by its use, we achieve the advantages of high fragment velocities and superior patterning.

As to the number of alternate layers of fragments and explosive, as many as fourteen discrete layers of fragments have been formulated into a warhead and successfully fired into controlled velocity and spatial distribution patterns.

Our novel layering technique in which discrete layers of fragments and explosive are employed results in the enhanced coupling of explosive energy to the fragments, and careful control over fragment directions. This of course is to be contrasted with prior art arrangements in which balls or fragments are individually embedded in explosive material, for in such arrangements, effective coupling is not present and the directions in which the fragments travel are random.

As will now be apparent, we have provided a novel and highly effective warhead which more effectively couples explosive energy to fragment packages, permits the projection of multiple layers of fragments, and provides means for controlling fragment velocities and distribution patterns in a highly desirable manner.

We claim:

1. A layered warhead for projecting a multitude of fragments in a highly controlled pattern, comprising alternating substantially continuous layers of fragments and explosive, means for bringing about an explosive detonation that is propagated through the layers of fragments and explosive at essentially right angles to the intersections between such layers, the occurrence of detonation in the explosive layer nearest said detonation means serving to expand the adjacent fragment layer against its adjacent explosive layer, thus compressing such adjacent explosive layer to a higher energy density before it detonates, such adjacent explosive layer detonating a very small increment of time after the first layer, and at a higher energy density, with such compression taking place with regard to each succeeding explosive layer, thereby increasing the energy in such explosive layers as they eject their respective fragment layers within a few microseconds of each other, and causing the discrete fragment layers to form a spatially desirable explosion pattern.

2. The layered warhead as defined in claim 1 in which said layers of fragments and explosive are disposed in substantially a concentric array.

3. The layered warhead as defined in claim 1 in which said layers of fragments and explosive are substantially planar layers.

4. The layered warhead as defined in claim 1 in which said layers of fragments and explosive form a substantially spiral configuration.

5. A layered warhead for projecting a multitude of fragments in a highly controlled pattern, comprising alternating layers of fragments and explosive, each fragment layer being an essentially solid structure of substantially uniform thickness, means for bringing about an explosive detonation that is propagated through the layers of fragments and explosive at essentially right angles to the intersections between such layers, such explosive detonation occurring in the layers of explosive substantially simultaneously so as to bring about the outward projection of the fragments of the various layers, the occurrence of detonation in the explosive layer nearest said detonation means serving to expand the adjacent fragment layer against the surrounding explosive layer, thus compressing such surrounding explosive layer to a higher energy density before it detonates, such surrounding explosive layer detonating a very small increment of time after the first layer, and at a higher energy density, with such compression taking place with regard to each surrounding explosive layer, thereby increasing the energy in the successive explosive layers as they eject their respective fragment layers, all of such explosive layers detonating within a few microseconds of each other, and serving to cause the discrete fragment layers to form a spatially desirable explosion pattern.

6. The layered warhead as defined in claim 5 in which said layers of fragments and explosive are disposed in substantially a concrete array.

7. The layered warhead as defined in claim 5 in which said layers of fragments and explosive are disposed in substantially a spiral configuration.

* * * * *